US011358017B2

(12) United States Patent
Wang

(10) Patent No.: US 11,358,017 B2
(45) Date of Patent: Jun. 14, 2022

(54) STABLE BASIN-SHAPED TRAMPOLINE

(71) Applicant: Siqi Wang, Dongguan (CN)

(72) Inventor: Siqi Wang, Dongguan (CN)

( * ) Notice: Subject to any disclaimer, the term of this patent is extended or adjusted under 35 U.S.C. 154(b) by 0 days.

(21) Appl. No.: 17/037,996

(22) Filed: Sep. 30, 2020

(65) Prior Publication Data

US 2021/0197005 A1 Jul. 1, 2021

Related U.S. Application Data

(63) Continuation of application No. PCT/CN2020/097566, filed on Jun. 23, 2020.

(51) Int. Cl.
*A63B 5/11* (2006.01)
*A63B 21/02* (2006.01)

(52) U.S. Cl.
CPC ..... *A63B 5/11* (2013.01); *A63B 21/02* (2013.01)

(58) Field of Classification Search
CPC ..... A63B 5/11; A63B 21/02; A63B 21/026; A63B 2071/0072; A63B 6/00; A63B 6/02; A63B 6/0407
See application file for complete search history.

(56) References Cited

U.S. PATENT DOCUMENTS 6,319,174 B1 * 11/2001 Alexander ..... A63B 5/11 482/27
8,105,211 B2 * 1/2012 Alexander ..... A63B 5/11 482/27
8,303,469 B2 * 11/2012 Alexander ..... A63B 5/11 482/27
9,339,676 B2 5/2016 Publicover et al.
9,492,698 B2 * 11/2016 Andon ..... A63B 5/11
9,643,039 B2 * 5/2017 Andon ..... A63B 71/022
9,707,426 B2 * 7/2017 Tsai ..... A63B 5/11
9,889,328 B2 2/2018 Tang
10,010,736 B2 7/2018 Chen
10,029,133 B2 * 7/2018 Miller ..... A63B 21/026
10,092,787 B2 10/2018 Chen
10,391,359 B2 * 8/2019 McGrane ..... A63B 24/0003
10,646,737 B2 5/2020 Publicover et al.
10,814,153 B1 * 10/2020 Wang ..... A63B 71/0054
(Continued)

FOREIGN PATENT DOCUMENTS

AU 2014100789 8/2014
CN 201380072581.3 7/2016
CN 201710258397.8 8/2017

*Primary Examiner* — Megan Anderson

(57) ABSTRACT

The present invention discloses a stable basin-shaped trampoline, which includes a frame, multiple resiliently flexible rods with lower ends and top ends respectively, and a bouncing mat; the lower end of each rod is inserted into the frame, and the bouncing mat is bridged arranged above the top ends of the rods; the outer diameter of the bouncing mat is less than that of the frame, the frame, the resiliently flexible rods and the mat encloses into an inverted basin-shaped structure with a relatively larger lower part and a small upper part; or, the outer diameter of the bouncing mat is larger than that of the frame, the frame, the resiliently flexible rods and the bouncing mat encloses into a basin-shaped structure with a large upper part and a small lower part. The basin-shaped structure increases the stability of the trampoline and makes the trampoline not easy to flip.

8 Claims, 2 Drawing Sheets

(56) References Cited

U.S. PATENT DOCUMENTS

| | | | | |
|---|---|---|---|---|
| 10,940,353 | B2 * | 3/2021 | Fischer | A63B 5/11 |
| 11,027,164 | B2 * | 6/2021 | Wang | A63B 71/0054 |
| 2021/0187338 | A1 * | 6/2021 | Wang | A63B 5/11 |

* cited by examiner

STABLE BASIN-SHAPED TRAMPOLINE

FIELD OF THE INVENTION

The invention relates to the technical field of trampoline, more particularly relates to a stable basin-shaped trampoline.

BACKGROUND OF THE INVENTION

Trampolining, which is also known as "aerial ballet", is a kind of jumping sport by the use of rebound force, which provide great fun, and deeply loved by children. It is the favourite family sports equipment of thousands of households.

The safety and stability of the small trampoline are the focus to which having drawn the attention because of the small size for family uses. Chinese application No. CN201920183818.X discloses a trampoline includes a frame (1) which is connected with a mat, multiple supporting legs (2) which are connected to the frame (1) for supporting the frame (1) and the mat, a handrails (3) which is arranged on the side of the frame (1) and a support rod (4) which is arranged to be connected with the handrails (3), wing rods are arranged to be connected with the support rod (4) at the its corresponding position to the frame (1), The wing rods extend along the outer edge of the frame (1) and are fixedly connected with the frame (1). The Chinese patent CN201920183818.X discloses wing rods to connect the support rod (4) so as to fixed connecting the wing rods with the frame, which can better counteract the transverse direction force produced by the user holding the handrail in the bouncing process on the trampoline, and improve the stability of the connection between the support rod and the frame.

However, the weight of household small trampoline is light, which increasing the possibility of the userlanding on the edge of the trampoline during bouncing which can easily cause the flip of the trampoline, and thus has safety risks. The multiple supporting legs provided in Chinese application CN201920183818.X further increases the flipping risk of trampoline.

Additionally, the installation of trampoline, including multi steps, are complex, it is very difficult for unprofessional people to do the assemble.

Therefore, how to effectively increase the stability of household trampoline and simplify the installation process are the technical problems urgently to be solved.

SUMMARY OF THE INVENTION

In order to overcome the shortcomings of the prior art, the present invention discloses a stable basin-shaped trampoline so as to resolve the technical problems of poor stability and difficulty in installation of small trampoline in the prior art.

The technical scheme of the invention is as follows: a stable basin-shaped trampoline, includes a frame, multiple resiliently flexible rods with a lower end and an upper end of each of the rod, and a bouncing mat; the lower end of each rod is inserted into the frame, and the bouncing mat is erected at the top ends of the rods; the outer diameter of the bouncing mat is less than that of the frame, therefore the frame, the resiliently flexible rods and the bouncing mat enclose to form an inverted basin-shaped structure which having a relative larger diameter of lower part than that of the upper part; or, the outer diameter of bouncing mat is larger than that of the frame, therefore, the frame, the resiliently flexible rods and the bouncing mat enclose into a basin-shaped structure which having a relatively larger upper part than that of the lower part.

The resiliently flexible rods are obliquely inserted into the frame, the resiliently flexible rods are bent towards the central line of the frame when the flexible rods under bouncing force.

The top end of the each resiliently flexible rod is bent towards itself so as to form a ring-shaped top having an opening; the bouncing mat is provided around its periphery with multiple pulling ring-belts with a mouth respectively, each of the pulling ring-belt and the corresponding ring-shaped top of the rod are connected by a connecting member.

The connecting member can be ring-shaped buckle, the ring-shaped buckle connects with a ring-shaped top having an opening and extends through the mouth of the pulling ring-belt, therefore connecting the resiliently flexible rods and the pulling ring-belt.

The ring-shaped buckles can be in circular, elliptical, D or triangular shape.

The connecting member can be a circular ring with its outer diameter less than or greater than that of the frame, the circular ring passes through the mouth of each of the pulling ring-belts, and the bouncing mat is tightened in the circular ring. The resiliently flexible rods are hung on the circular ring by hanging the ring-shaped top having an opening of the rods on the circular ring.

The frame is provided with a plurality of supporting pads underneath.

The frame is fixed with a plug-in tube and a handrail is plugged into the plug-in tube.

The handrail comprises a supporting stick with a top end and a grip which is arranged at the top end of the support stick; the supporting stick is inserted in the plug-in tube.

The frame is fixed with inclined tubes in which the lower end of each of the flexible rods are inserted respectively.

The beneficial effect of the present invention is that: the basin-shaped structure increases the stability of the trampoline and prevents the trampoline from flipping. In addition, the installation process becomes simple and convenient by arranging the connect member to connect the flexible rod and the bouncing mat, the bouncing mat has good tension and provides high bouncing comfort.

DETAILED DESCRIPTION OF ILLUSTRATED EMBODIMENTS

In order to achieve the aim of the invention, and also make the technical scheme and the technical effect more clear, the invention is further explained in combination with the embodiments. It should be understood that the specific embodiments described here are used only to explain the invention and are not used to limit the invention.

Figure 1:
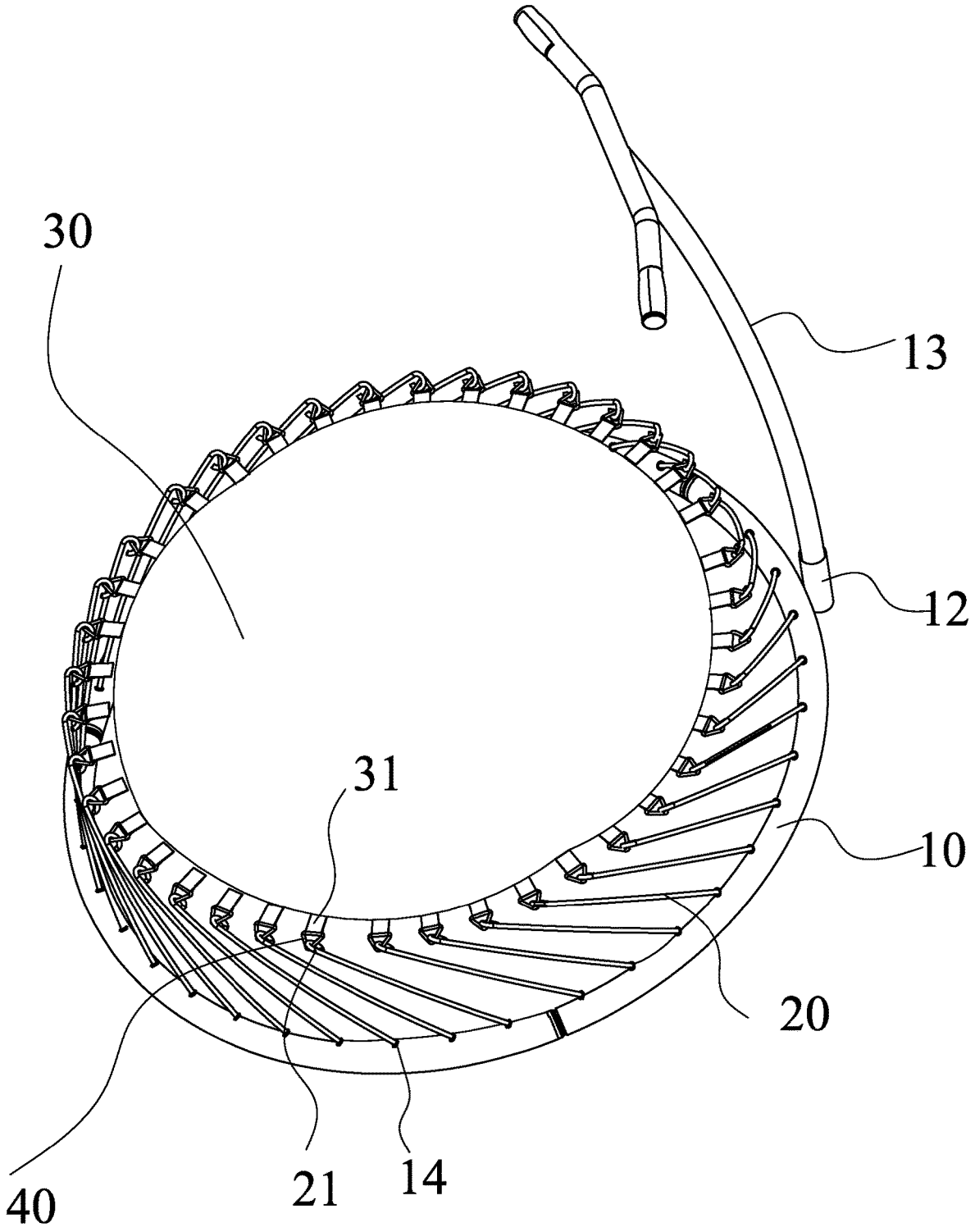
FIG. 1 is a schematic diagram of the structure of the stable basin-shaped trampoline in the present application.
Figure 2:
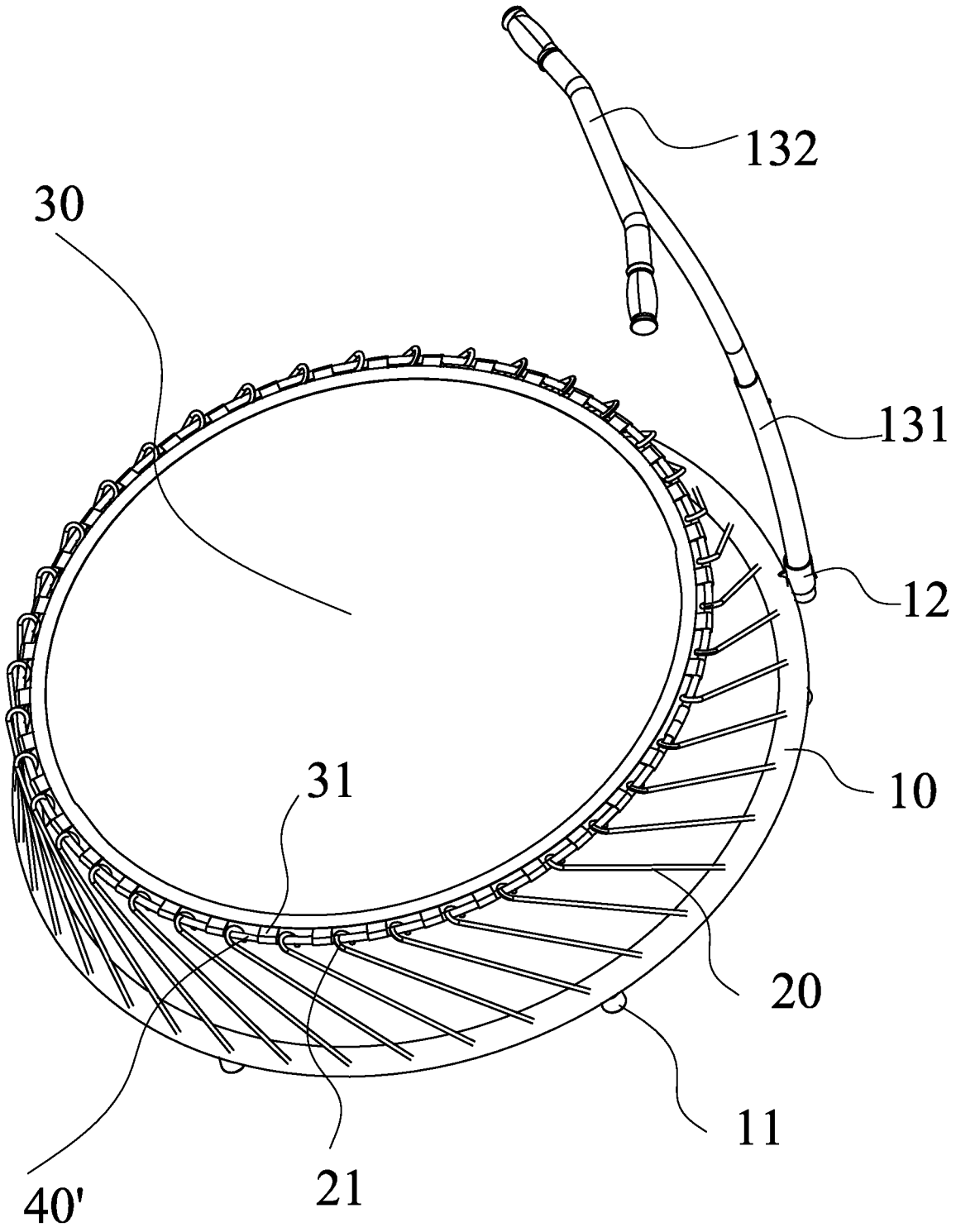
FIG. 2 is a schematic diagram of another embodiment of the stable basin-shaped trampoline in the present application.

Referring to FIG. 1, a stable basin-shaped trampoline includes a frame 10, multiple resiliently flexible rods 20 with lower ends and upper ends and a bouncing mat 30. The lower end of each of the resiliently flexible rod 20 is inserted into the frame respectively, and the bouncing mat 30 is erected on the top ends of the resiliently flexible rods 20. The outer diameter of the bouncing mat 30 is less than that of the frame 10; the frame 10, the resiliently flexible rods 20 and the bouncing mat 30 thus enclose into an inverted basin-shaped structure which have a diameter of a lower part relatively larger than that of a upper part; or, the outer diameter of the bouncing mat 30 is larger than that of the frame 20; the frame 10, the resiliently flexible rods 20 and the bouncing mat 30 thus enclose into a inverted basin-shaped structure which have a diameter of an upper part relatively larger than that of the lower part. The inverted basin-shaped structure or the basin-shaped structure is stable enough, which will prevent the trampoline from flipping even if it is under unevenly distributed loads, such as when the user feet land at the edge of the bouncing mat.

The resiliently flexible rods 20 are obliquely inserted into the frame 10. The resiliently flexible rods 20 bend towards the center of the frame 10 under the user's bounce. This kind of structure suits for the situation when the outer diameter of the frame 10 is larger than that of the bouncing mat 30, it also suits for the situation when the outer diameter of the frame 10 is smaller than that of the bouncing mat 30, this kind of structure also provides the convenient of smoothy assembly.

In another embodiments in the present invention, the upper end of the resiliently flexible rod 20 is bent towards itself so as to form a ring-shaped top 21 with an opening mouth; the bouncing mat 30 is provided around its periphery with multiple pulling ring-belts 31, and each of the pulling ring-belt 31 and each of the corresponding ring-shaped top 21 are connected by a connecting member 40. The connecting members 40 makes the installation of the resiliently flexible rod 20 and the bouncing mat 30 becoming extremely simple and labor-saving, and the operation is convenient. After the installation is completed, the bouncing mat 30 is tensioned tightly at the top ends of the flexible rods 20.

Preferably, in an embodiment of the present invention, the connecting members 40 are multi ring-shaped buckles, each of the ring-shaped buckles 40 connects with the ring-shaped top 21 of the resiliently flexible rod 20 and extends through the pulling ring-belt 31, thereby connecting the resiliently flexible rod 20 and the bouncing mat 30. The ring-shaped buckle can be shaped like a circle, an ellipse, a D shape, a triangle, etc., preferably a triangle. After the triangular shaped buckle is connected with the pulling ring-belt 31 and the ring-shaped top 21, the pulling ring-belt 31 and the ring-shaped top 21 are not easily sliding. This kind of structure makes the installation of trampoline easier and labor-saving. After installation, the bouncing mat 30 is tightly tensioned and elastic.

Preferably, in another embodiment of the invention, the connecting member 40' is a circular ring with its outer diameter less than or greater than that of the frame 10, the circular ring passes through the mouth of the pulling ring-belt 31, and the bouncing mat 30 is tightened tightly in of the circular ring. The flexible rods 20 are hung down from the circular ring by applying the ring-shaped tops 31 hanging on the circular ring at. After the trampoline is installed, the bouncing mat 30 is tightly tensioned, and when the user jumps on the trampoline, the pressure is evenly distributed on each of the flexible rods 20, which makes the flexible rods 20 not easily to bend, the bouncing mat has good elastic force and highly improved comfort level.

Preferably, in an embodiment of the invention, the frame 10 is provided with a plurality of supporting pads 11 at underneath its bottom surface.

Preferably, in an embodiment of the invention, the frame 10 is fixed with a plug-in tube 12 and a handrail 13 is plugged into the plug-in tube 12. The structure facilitates the installation and disassembly of the handrail 13. When the user jumps on the trampoline, the handrail 13 can increase the safety and prevent the user from falling down. The handrail 13 also increases the stability of the trampoline.

Preferably, in an embodiment of the invention, the handrail 13 comprises a supporting stick 131 with a top end and a grip 132 which is arranged at the top end of the supporting stick 131; the supporting stick 131 is inserted in the lug-in tube 12.

Preferably, in an embodiment of the invention, the frame 10 is fixed with inclined tubes 14 in which the low ends of the flexible rods 20 are inserted respectively.

The above contents are further detailed instructions to the invention in combination with the specific optimal embodiments, and it can not be concluded that the embodiments of the invention are limited to these instructions. For ordinary technicians in the technical field of the invention, without breaking away from the conception of the invention, the structure form can be flexible and changeable, and the series of products can be derived. Only a few simple deductions or replacements should be regard in the protection scope of the present invention

What is claimed:

1. A stable basin-shaped trampoline, comprising a frame, resiliently flexible rods each having a lower end and an upper end, and a bouncing mat; said lower ends are inserted into said frame, and said bouncing mat is erected on said upper ends of the resiliently flexible rods, wherein, an outer diameter of said bouncing mat is less than that of said frame, wherein, said frame, said resiliently flexible rods and said bouncing mat enclose to form an inverted basin-shaped structure having a larger diameter of a lower part than that of an upper part; or, said outer diameter of said bouncing mat is larger than that of said frame, wherein, said frame, said resiliently flexible rods and said bouncing mat enclose to form a basin-shaped structure having a larger diameter of an upper part than that of a lower part;

wherein said upper end of each of said resiliently flexible rods is bent to itself so as to form a ring-shaped top having an opening; said bouncing mat is provided around its periphery with multiple pulling ring-belts with mouths respectively, and each of said multiple pulling ring-belts and each of said ring-shaped tops are correspondingly connected by a respective connecting member;

wherein each of the respective connecting members is a ring shaped buckle that connects a respective said opening of said ring shaped tops to a respective said mouth of said pulling ring belt, therefore connecting each of said resiliently flexible rods with each of said pulling ring belts.

2. The stable basin-shaped trampoline according to claim 1, wherein each said ring-shaped buckle is in circular, elliptical, D or triangular shape.

3. The stable basin-shaped trampoline according to claim 2, wherein each said connecting member is a circular ring with its outer diameter less than or greater than that of said frame, each said circular ring passes through the respective mouth of each of said pulling ring-belts, and said bouncing mat is tightened in the middle of said circular ring, said resiliently flexible rods are hung on said circular ring by hanging said respective openings of the ring-shaped tops of said resiliently flexible rods on said circular ring.

4. The of the stable basin-shaped trampoline according to claim 1, wherein said frame is fixed with a plug-in tube and a handrail is plugged into said plug-in tube.

5. The stable basin-shaped trampoline according to claim 4, wherein said handrail comprises a supporting stick and a grip which is arranged at a top end of said supporting stick; said supporting stick is inserted in said plug-in tube.

6. The stable basin-shaped trampoline according to claim 1, wherein said resiliently flexible rods are obliquely inserted into said frame, said resiliently flexible rods are bent towards a central line of said frame when said resiliently flexible rods are under bouncing force.

7. The of the stable basin-shaped trampoline according to claim 1, wherein said frame is provided with a plurality of supporting pads underneath.

8. The of the stable basin-shaped trampoline according to claim 1, wherein said frame is fixed with inclined tubes in which said lower end of each of said resiliently flexible rods is inserted respectively.

* * * * *